US005407398A

United States Patent [19]

Werlberger

[11] Patent Number: 5,407,398

[45] Date of Patent: Apr. 18, 1995

[54] DUAL DRUM DRIVE UNIT

[76] Inventor: Josef Werlberger, 6335, Thiersee 423, Austria

[21] Appl. No.: 963,576

[22] Filed: Oct. 19, 1992

[30] Foreign Application Priority Data

Oct. 18, 1991 [AT] Austria ..... 2083/91
Jun. 23, 1992 [AT] Austria ..... 1297/92

[51] Int. Cl.[6] ..... B66D 1/26; B66D 1/22

[52] U.S. Cl. ..... 475/219; 475/221; 475/298; 254/297; 254/310

[58] Field of Search ..... 254/295, 297, 298, 210, 254/375, 377; 475/219, 221, 234, 259, 298, 299

[56] References Cited

U.S. PATENT DOCUMENTS

| | | | |
|---|---|---|---|
| 1,269,524 | 6/1918 | Collier | 475/219 |
| 3,092,370 | 6/1963 | Kennedy | 254/297 |
| 3,460,807 | 8/1969 | Prikhodko et al. | 254/297 |
| 4,216,942 | 8/1980 | Takematsu et al. | 254/310 |
| 4,449,697 | 5/1984 | Hicks | 254/297 |

FOREIGN PATENT DOCUMENTS

| | | | |
|---|---|---|---|
| 30043 | 6/1964 | German Dem. Rep. | 254/310 |
| 2518753 | 11/1976 | Germany . | |
| 3316530 | 11/1984 | Germany . | |
| 338578 | 7/1959 | Switzerland | 254/310 |
| 650327 | 1/1948 | United Kingdom | 254/310 |
| 260860 | 10/1971 | U.S.S.R. | 254/297 |

*Primary Examiner*—Dirk Wright
*Assistant Examiner*—Khoi Q. Ta
*Attorney, Agent, or Firm*—Henry M. Feiereisen

[57] ABSTRACT

A dual drum drive unit, in particular for a ropeway, with at least one motor includes a transmission unit for dividing the motor power to the drums in order to attain a high efficiency. The transmission unit includes a first gearing which is operatively connected to the motor and has an output, and a second gearing which is operatively connected to the first gearing and has two outputs which are respectively connected to the drums, with the output of the first gearing being selectively connectable with the two outputs of the second gearing.

15 Claims, 8 Drawing Sheets

DUAL DRUM DRIVE UNIT

BACKGROUND OF THE INVENTION

The present invention refers to a dual drum drive unit, in particular for a ropeway, of the type having at least one motor.

Such drive units are frequently used for ropeways in which a carriage is held via a rope and a counter rope by a track carrying rope, with the carriage being clamped upon the track carrying rope by means of a locking device which is controlled by both ropes. Subsequently one of the ropes is reeled off and used as load-carrying rope for receiving a load.

Known drive units of this type include for each drum a separate drive, usually two hydraulic motors. In order to tighten the counter rope, the separated arrangement of two hydraulic motors requires a provision of a respective counterpressure which, during unwinding of the respective rope, is lost as braking power. A further drawback of such a conventional drive unit is the speed-dependency of the efficiency of the hydraulic motors which means that at higher speed the efficiency considerably decreases. Moreover, the hydraulic motors which are generally used for this application are essentially provided to generate a high tensile force so that only relatively small speeds can be attained. This, however, leads to relatively time consuming idle runs in ropeways of greater length of for example 600 m or more, as used for example in logging.

Such conventional drive units encounter further problems with regard to the highly stressed hoses and seals of the hydraulic unit which may cause a shutdown of the operation. In particular, when used in less accessible regions, such operational breakdowns lead to long stoppages until the required replacement parts are delivered on site.

SUMMARY OF THE INVENTION

It is an object of the present invention to provide an improved dual drum drive unit obviating the aforestated drawbacks.

In particular, it is an object of the present invention to provide an improved dual drum drive unit which is of simple structure and characterized by a high efficiency while yet operating at high speeds.

These objects and others which will become apparent hereinafter are attained in accordance with the present invention by operatively connecting the motor with a transmission unit for dividing the power of the motor to the drums, with the transmission unit including a first gearing operatively connected to the motor and having an output, and a second gearing coupled to said first gearing and having a first and a second output which are each connected to a drum wherein the output of the first gearing is selectively connectable with the first and second outputs of the second gearing.

In this manner, both drums can be driven at different torques. By driving both drums via a power divider transmission unit the braking torque generated by one rope in one drum is transmitted to the second drum as driving torque. Thus, the drive unit is characterized by a high efficiency. Moreover, the provision of a transmission between the single motor and the drums results in considerably less maintenance work compared to hydraulic drives. The arrangement of such a transmission unit allows also high winding speeds so that the period for unavoidable idle runs, e.g. during logging, is considerably shortened and the transport capacity is greatly increased.

Preferably, an incrementally controllable reduction gear is interposed between each output of the second gearing and the pertaining drum. The provision of such interposed reduction gears results in considerably flexible application of such a drive unit with regard to the design of the transport device being operated. The use of such a reduction gear allows an active unreeling of the hoisting rope in ropeways in which the carriage is transported by hauling ropes and return ropes running in a same direction and in which a hoisting rope which may be formed also by the hauling rope is guided via the carriage and retained by the drums together with the return rope at the upper end of the inclined transport track. Thus, such a transport device can be utilized for long and relatively flat tracks in which so far the weight of the hoisting rope caused problems during unreeling thereof from the carriage at the end of the track being distant to the dual drum drive unit.

According to a further feature of the present invention, each gearing may be provided in form of a planetary gear train, with the planetary gear train of the first gearing having an annulus which is selectively connectable with the second gearing via a planet carrier which is connected to one of the drums or via an annulus which is connected to the other one of the drums. The use of such planetary gear trains results in a simple and compact structure of the transmission unit which can be made at short overall length.

Suitably, the annulus of the first planetary gearing meshes with planet wheels of the first gearing and is shiftable in an axial direction along an internal toothing which depending on the position of the annulus is engageable with teeth on the planet carrier of the second planetary gearing or with external teeth on the annulus of the second planetary gearing, with the internal toothing of the annulus of the first planetary gearing having an axial length which corresponds to the path of displacement and with the sun wheels and the planet carriers of both planetary gearings being each nonrotatably secured to a shaft.

Thus, one output of the first planetary gearing is defined by its annulus and can selectively coupled in an easy manner, and its other output is defined by its sun wheel which is connected to the second planetary gearing via its input which is also defined by a sun wheel.

In accordance with a further feature of the present invention, each gearing may be provided in form of differentials, with the bell-shaped box of the first differential being selectively connectable with the second differential via a bell-shaped box which is nonrotatably secured to one of the drums or an output gear which is nonrotatably secured to the other one of the drums. The provision of the gearings in form of differentials also results in a simple and slender structure.

Preferably, the connection of both differentials is attained by means of a sleeve which is guided in an axial direction and meshing with teeth on the box of the first differential. Depending on its position, the sleeve engages the box or the output gear of the second differential. Thus, the output of the first differential can easily be coupled with either one of both outputs of the second differential.

According to yet another feature of the present invention, both outputs of the second gearing which are respectively connected to the drums may each be provided via a freewheel with a brake, preferably a non-contacting brake such as an eddy current brake or a hydraulic brake. In this manner, always the one drum from which the rope is unreeled is braked. Suitably, both freewheels may lock in the same direction.

In order to increase the efficiency of the dual drum drive unit, both outputs of the second gearing are operatively connected via a freewheel with a brake and via a power distributor unit with the first gearing. In this manner, energy required for braking the unwinding drum may essentially be recovered by supplying this energy via the first gearing to the take-up drum.

Preferably, the power distributor unit may include a pump which is controllable by a pressure fluid and connected to a motor driven by the pressure fluid. This results in a simple construction and allows alteration of the rope tension through variation of the pressure delivered by the pump. Thus, essentially proportional conditions are attained, with the rope tension being adjusted in an especially simple manner.

The power distributor unit may preferably be formed by a torque converter.

According to a further modification of the present invention, the power distributor unit may also be designed as a planetary gear train to thereby provide a purely mechanical structure and thus to avoid any hydraulic means.

According to yet another feature of the present invention, the first and second gearings may be provided in form of cylindrical gear differentials (straight or spur differentials) to provide a very robust and secure construction with relatively simple individual parts.

BRIEF DESCRIPTION OF THE DRAWINGS

The above and other objects, features and advantages of the present invention will now be described in more detail with reference to the accompanying drawing in which.

DETAILED DESCRIPTION OF PREFERRED EMBODIMENTS

Figure 1:
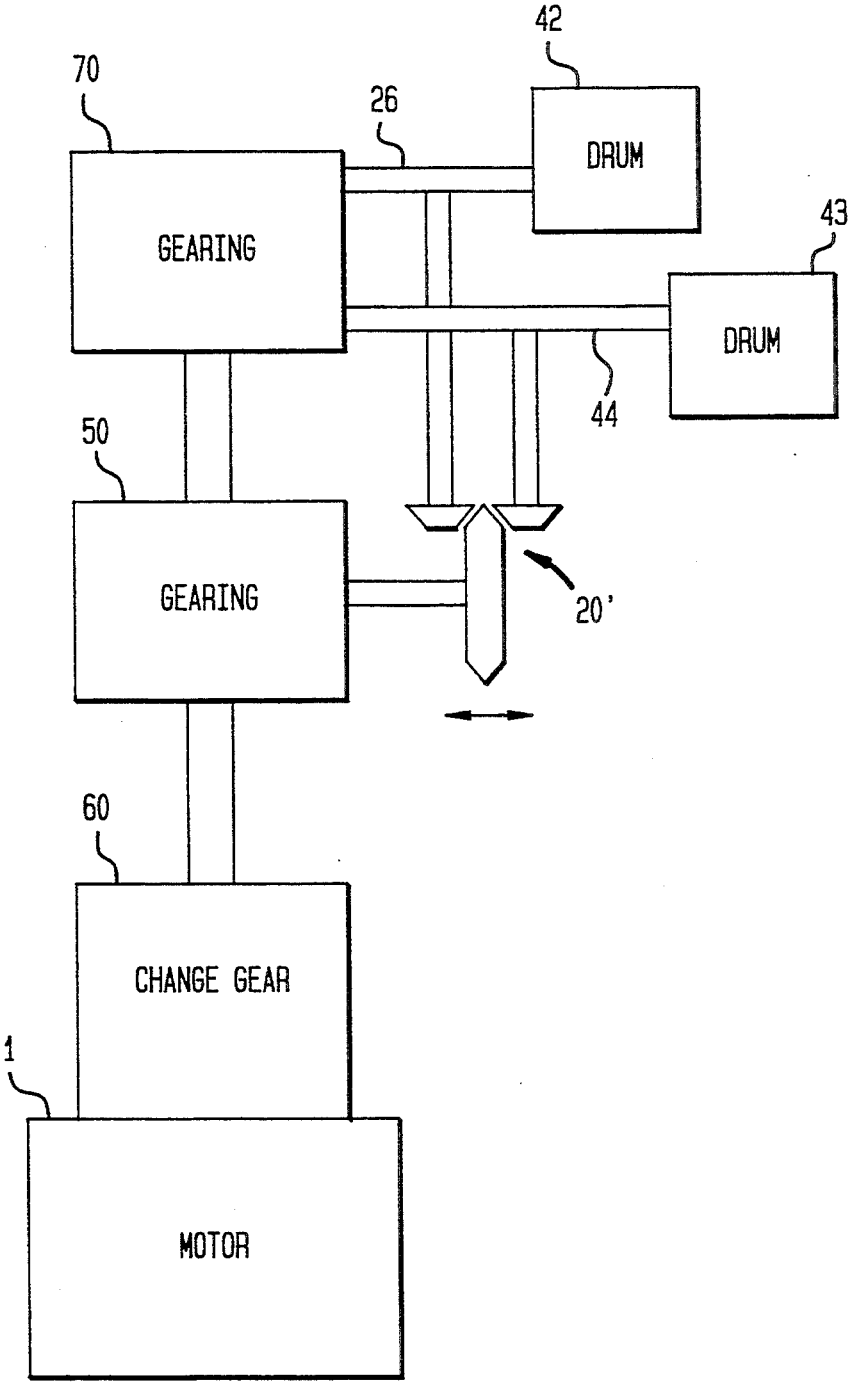
FIG. 1 is a general schematic block diagram of a dual drum drive unit in accordance with the present invention.

Throughout all the Figures, the same or corresponding elements are always indicated by the same reference numerals.

Referring now to the drawing and in particular to FIG. 1, there is shown a general schematic block diagram of a dual drum drive unit according to the invention, with a motor 1 which drives via a change gear or reversing gear 60 a transmission unit in form of a first gearing 50 and a second gearing 70 for dividing the power of the motor 1 to the drums 42, 43 of the dual drum drive unit. As illustrated in FIG. 1, the motor-distant gearing 70 is provided with two outputs 26, 44, with output 26 being operatively connected to drum 42 and output 44 being operatively connected to drum 43. The first gearing 50 which is in proximity to the motor 1 has one output which is selectively connectable with either one of both outputs 26, 44 via a two-way switching device 20' for allowing both drums 42, 43 to run at different torques.

Figure 2:
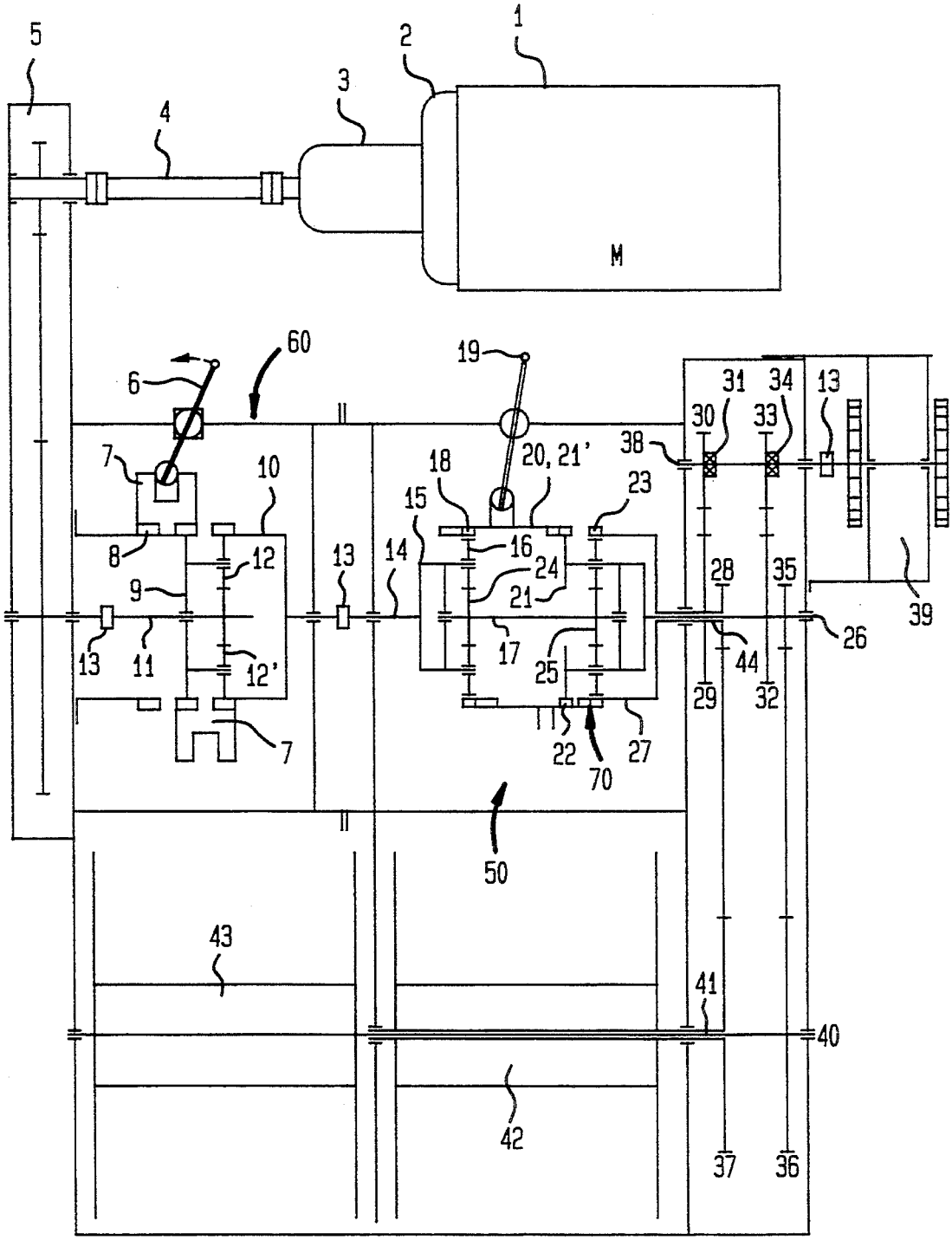
FIG. 2 is a detailed schematic illustration of a dual drum drive unit according to FIG. 1.

Turning now to FIG. 2, there is shown a more detailed schematic illustration of the dual drum drive unit according to FIG. 1. The motor 1 is connected via a converter 2 and a power shift transmission 3 and a cardan shaft 4 with a reduction gear 5 which drives the change gear 60 via a shaft 11. In order to facilitate any maintenance work, the shaft 11 is separable via a coupling 13. The change gear 60 is provided in form of a planetary gear train, with the planet carrier 9 being loosely and rotatably secured upon the shaft 11 and selectively connectable by means of a lever 6 operated two-way switch 7 with a housing portion 8 or with an annulus 10 which meshes with planet wheels 12. The planet wheels 12 mesh with a sun wheel 12' which is nonrotatably secured to the shaft 11.

In the position of the two-way switch 7 as illustrated in the upper area of the change gear 60, the planet carrier 9 is connected to the housing portion 8 so that the planet wheels 12 act as intermediate gears and cause the annulus 10 to rotate in opposite direction to the shaft 11.

In the position of the two-way switch 7 as illustrated in the lower area of the change gear 60, the planet carrier 9 is connected with the annulus 10 so as to rotate the planet carrier 9 in unison with the annulus 10 and to attain rotation of the sun wheel 12' and of the annulus 10 in a same direction.

The change gear 60 is connected via a further coupling 13 with the two gearings 50 and 70 which are arranged in a common housing and also provided in form of planetary gear trains.

The motor-near gearing 50 is provided with a planet carrier 15 which is nonrotatably secured to a Shaft 14. Planet wheels 16 mesh with a sun wheel 24 which is nonrotatably secured to a shaft 17 and with a sleeve-like annulus 20 which represents the two-way switching device 20'. The annulus 20 is guided for axial displacement and provided with an internal toothing 18 which has an axial length corresponding to the axial displacement of the annulus 20.

By means of the gearing 50, the torque supplied from the motor 1 via the shaft 14 is divided, with one portion being transmitted via the sun wheel 24 to the annulus 20 which is selectively engageable with the second gearing 70 via a toothing 22 on a planet carrier 21 or a toothing 23 on an annulus 27 so as to allow a selective transmission of the torque to either one of the drums 42, 43. The other portion of the torque as supplied by the motor 1 through shaft 14 is transmitted to the output shaft 26 of the second gearing 70 and thus to the drum 42 via the sun wheel 24, sun wheel 25 which is nonrotatably secured with the sun wheel 24 via the shaft 17 and further via planet wheels 16 and planet carrier 21.

As shown in FIG. 2, switching and thus displacement of the annulus 20 in axial direction is indicated in FIG. 2 by means of a lever 19 which is retained in the housing, with the length of the internal toothing 18 of the annulus 20 which meshes with the planet wheel 16 of the gearing 50 corresponding to the length of the axial displacement of the annulus 20 which serves as the two-way switching device 20' as indicated in FIG. 1.

As is further illustrated in FIG. 2, the planet carrier 21 of the second gearing 70 is nonrotatably secured via the output shaft 26 with cylindrical gears 32, 35, with gear 32 meshing via a freewheel 34 with a gear 33 connected to a brake shaft 38. The annulus 27 of the second gearing 70 is nonrotatably secured with gears 28, 29 via the hollow output shaft 44 which encloses the output shaft 26. The gear 29 meshes via a further freewheel 31 with a gear 30 which is connected to the brake shaft 38. Both freewheels 31, 34 lock in a same rotational direction, and the brake shaft 38 is nonrotatably secured via a coupling 13 with a brake, preferably an eddy current brake 39. Another example for a brake may be a hydraulic brake. A locking in a same direction of both freewheels 31, 34 ensures that the one drum 42, 43 from which the rope is unreeled is braked.

Gears 28 and 35 are operatively connected with further gears 37, 36, with a respective reversing gear being interposed. The gear 36 is nonrotatably secured via a shaft 40 to the drum 43 and gear 37 is nonrotatably secured to the drum 42 via a hollow shaft 41 which encloses the shaft 40.

In a ropeway operated by a rope and counter rope, both drums 42, 43 are driven in the same rotational direction at different torque through provision of the first gearing 50 by which the torque is divided. The torque transmitted to the unwinding drum is of such magnitude as to sufficiently tighten the unreeling rope. The torque transmitted by the unreeling rope to the respective drum causes a reversal of the rotational direction of the respective drum, with this torque being transmitted via both gearings 50, 70 to the take-up drum.

By providing reversing gears between the output shafts 26, 44 and the drums 42, 43, the dual drum drive unit may also be applicable for other ropeways as set forth above.

Figure 3:
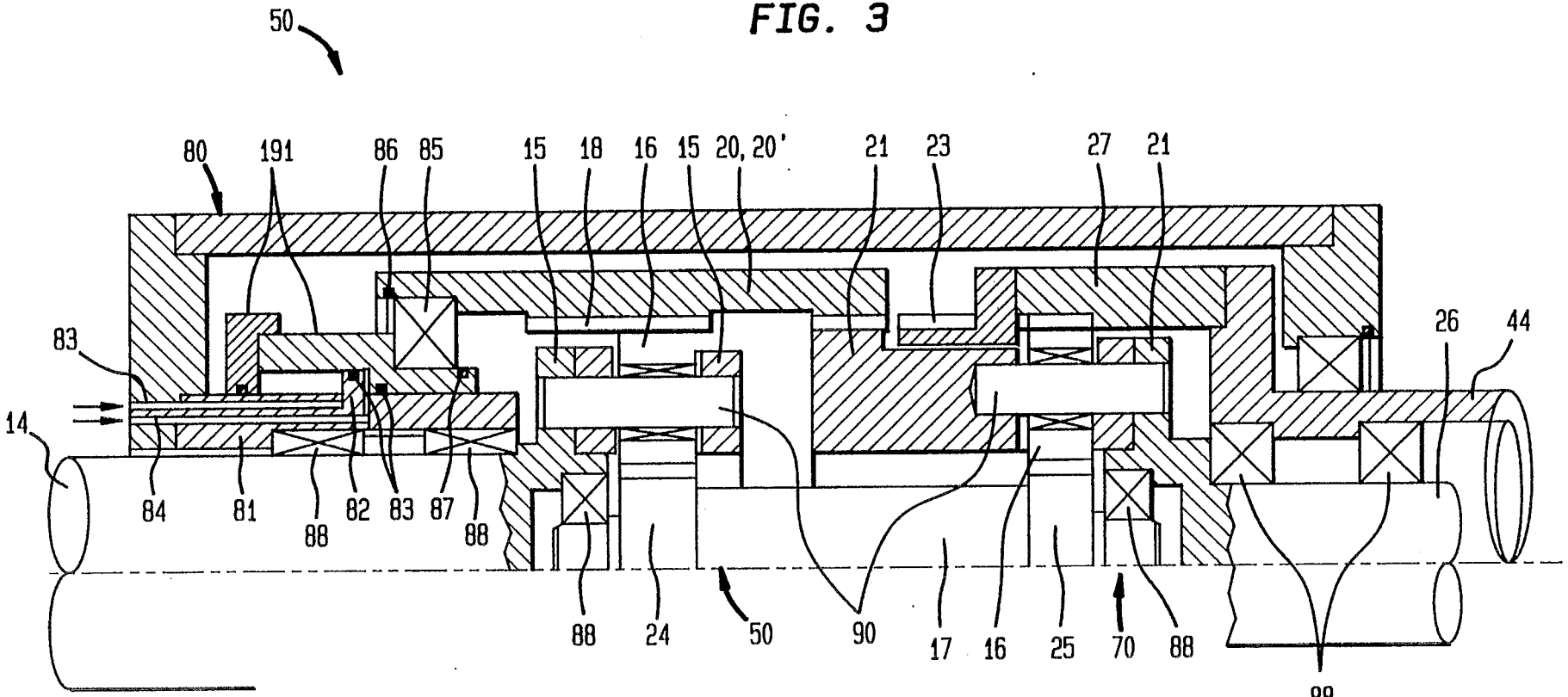
FIG. 3 is a longitudinal section of a first embodiment of a transmission unit for dividing the motor power to the drums of a dual drum drive unit according to the invention.

Turning now to FIG. 3, there is shown a longitudinal section of one embodiment of gearings 50, 70 of a dual drum drive unit according to the invention. As can be seen from FIG. 3, the annulus 20 of the motor-near gearing 50 which serves as two-way switching device 20' is acted upon by a pressure fluid operated cylinder 191 for attaining the displacement of the annulus 20 in an axial direction along the internal toothing 18. The cylinder 191 bears upon a support 81 which is securely fixed to the housing 80 and provided with a flanged extension 82 acting as a piston. Seals 83 seal the extension 82 against the cylinder 191 and the cylinder 191 against the support 81.

Supply of pressure fluid is provided via two channels 83, 84 which extend within the support 81 and enter the interior of the cylinder 191 at both sides of the extension 82. The cylinder 191 is operatively connected to the annulus 20 via a bearing 85 and Seeger circlip rings 86, 87. Upon entry of pressure fluid into its interior, the cylinder 191 is shifted, with the motion being transmitted to the annulus 20 via bearing 85 and Seeger circlip rings 86, 87.

As shown in FIG. 3, the planet carrier 15 and the planet wheel 16 are suitably supported on a shaft 90, with the planet carrier 15 being of split configuration. One portion of the planet gear 15 extends at one side of the planet wheel 16 and is connected in one piece with shaft 14 while the other portion of the planet gear 15 extends at the other side of the planet wheel 16. Likewise, the planet gear 21 and the respective planet wheel 16 of the second gearing 70 is supported upon a shaft 90, with the planet carrier 21 being of split configuration. One portion of the planet carrier 21 at one side of the planet wheel 16 is provided with the external toothing 22 which is engageable by the annulus 20 of the first gearing 50, and the other part of the planet carrier 21 extends at the other side of the planet gear 16 and is connected in one piece with the output shaft 26. The shaft 17, which connects the sun wheels 24 and 25 of the gearings 50, 70 with each other, is suitably supported in recesses of the shafts 14 and 26 by means of rolling contact bearings 88.

Figure 4:
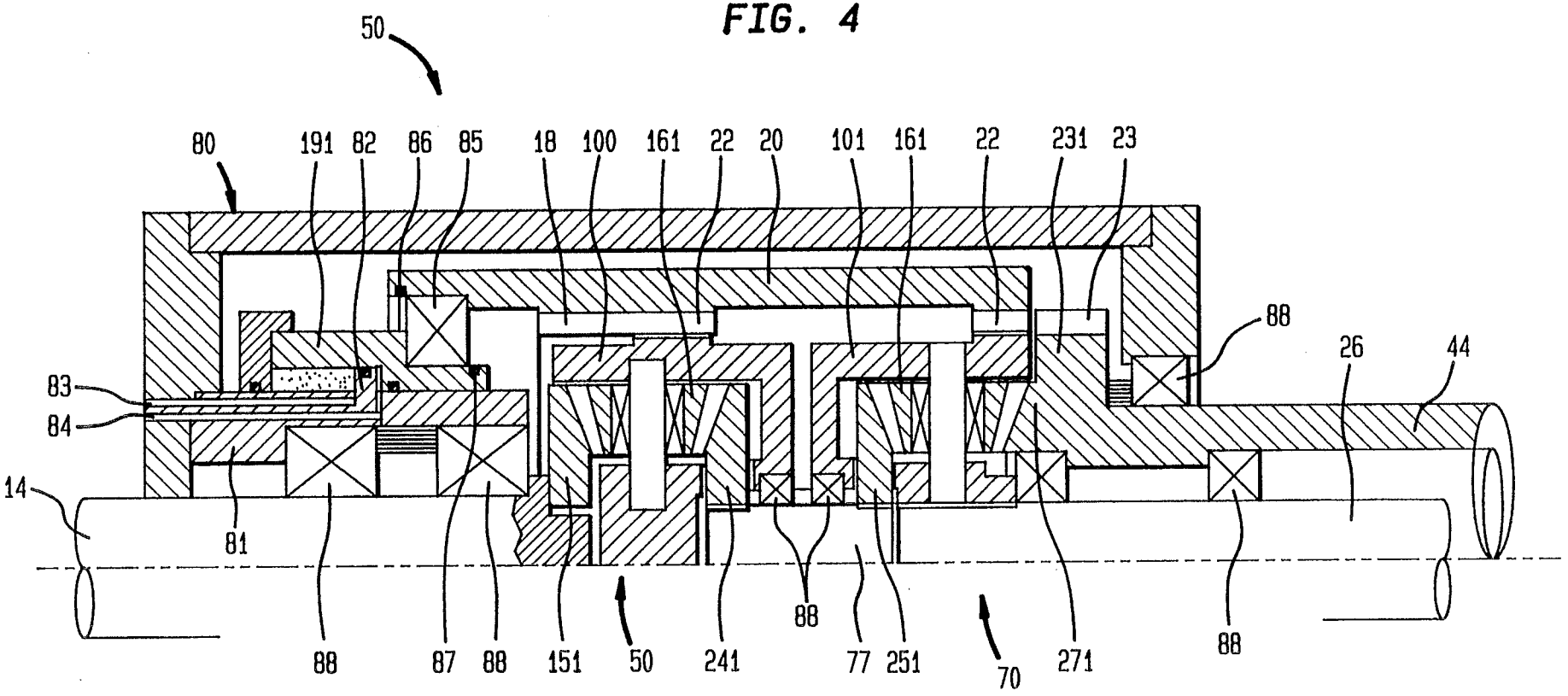
FIG. 4 is a longitudinal section of a second embodiment of a transmission unit for dividing the motor power to the drums of a dual drum drive unit according to the invention.

FIG. 4 shows a longitudinal section of a further embodiment of a transmission unit for dividing the motor power to the drums 42, 43, with both gearings 50, 70 being provided in form of a differential. The motor-near gearing 50 includes a bevel gear 151 which is nonrotatably secured to the shaft 14 and meshes differential gears 161 retained in a bell-shaped box 100 and meshing with an output gear 241. This output gear 241 is nonrotatably connected with a bevel gear 251 of the motor-distant gearing 70 via the shaft 17 by which the boxes 100, 101 of both differentials are supported via bearings 88. The bevel gear 251 meshes with differential gears 161 of the second gearing 70, with the differentials 161 being retained in the bell-shaped box 101 and meshing with an output ring gear 271 which is part of a flanged extension 31 of the hollow output shaft 44. As shown in FIG. 4, the flanged extension 231 is provided with an external toothing 23, with the box 101 of the second gearing 70 being nonrotatably connected to the output shaft 26.

The annulus 20 which serves as two-way switch 20' is configured in form of a sleeve with internal toothing 18 which is engageable with the external toothing 22 of the boxes 100, 101 or with the external toothing 23 of the flanged extension 231 of the output shaft 44. The displacement of the annulus 20 in axial direction to allow selective engagement of the toothing 22 or toothing 23 is attained by cylinder 191 through pressure fluid entering the support 81 through channels 83 and 84 and acting upon the flanged extension 82. Actuation of the cylinder 191 is attained in the same manner as described in connection with FIG. 3 so that further description thereof is omitted for sake of simplicity.

In the embodiment of the gearings 50, 70 in form of differentials, a portion of the torque supplied by motor 1 to the shaft 14 is transmitted by the two-way switching device 20' (annulus 20) either to the box 101 and thus to the output shaft 26 which is fixedly secured to the box 101 or to the toothing 23 and thus to the output shaft 44. The further portion of the supplied torque is transmitted via the differential gears 161 of the first gearing 50 to its output gear 241 and further via the bevel gear 251 and the differential gears 161 to the output shaft 44.

Figure 5:
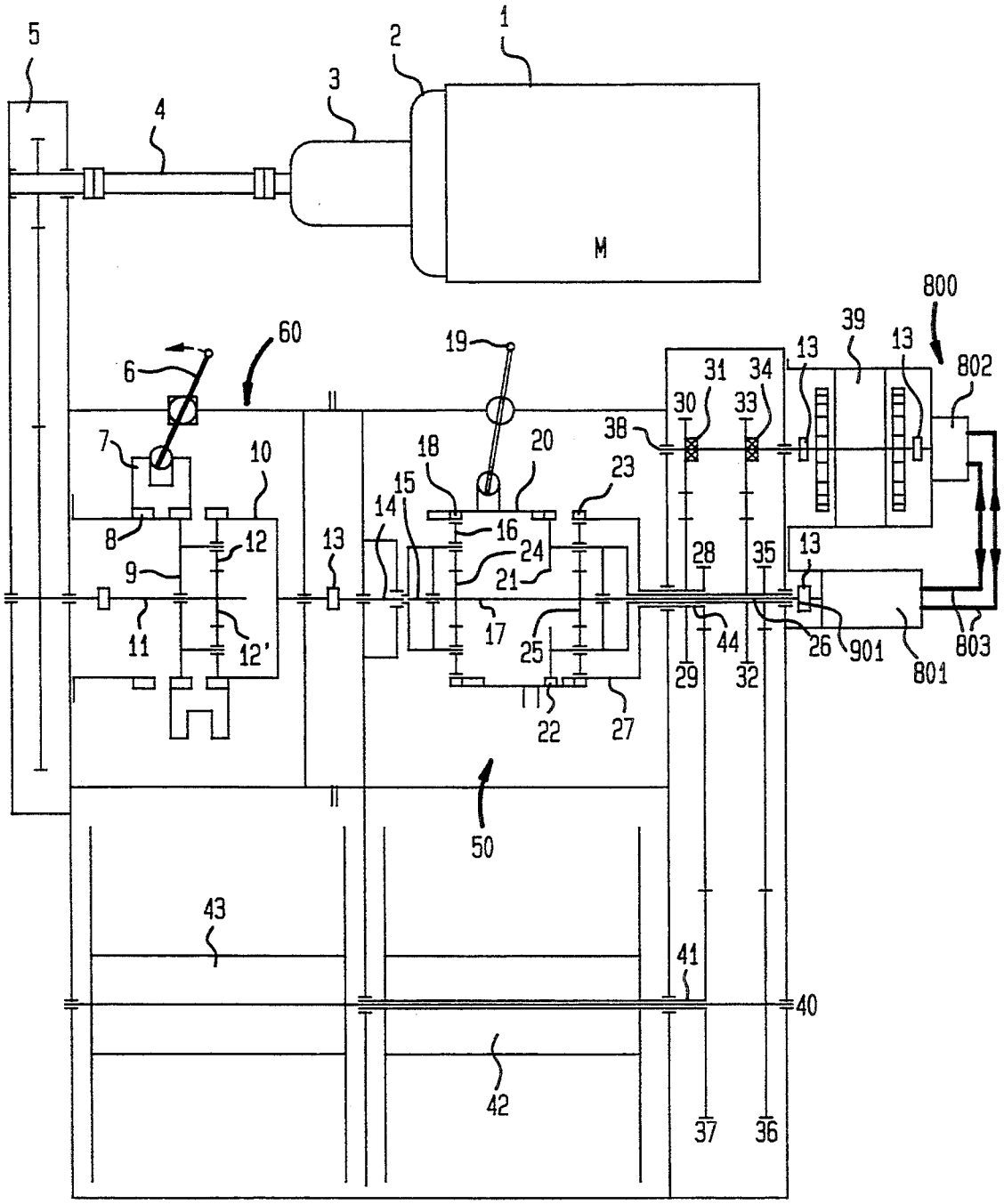
FIG. 5 is a detailed schematic illustration of another embodiment of the dual drum drive unit according to FIG. 1.

The embodiment of a dual drum drive unit according to FIG. 5 corresponds essentially to the embodiment as shown in FIG. 2. In the embodiment of FIG. 5, however, the shaft 14 is nonrotatably secured at operation via the coupling 13 with the shaft 11. Shaft 17 is rotatably supported relative to shaft 14, and the output shaft 26 is designed as a hollow shaft. Furthermore, the brake 39 can be detachably connected via coupling 13 with the brake shaft 38. Connected to the brake 39 via a further coupling 13 is a power distributor device, generally designated by reference numeral 800 and including a controllable pump 802 which communicates via conduits 803 with a motor 801 actuated by a pressure fluid e.g. pressure oil and linked via a coupling 13 with an extension 901 of the output shaft 17 of the gearing 50.

For adjustment of the rope tension, it is sufficient to set a respective pressure by means of the controllable pump 802 so as to generate a respective braking torque for the unwinding drum and to transmit the braking torque essentially via the motor to the take-up drum via the gearings 50, 70. Preferably, the connection of both drums 42, 43 may be provided hydrodynamically via a not shown braking torque converter.

Figure 6:
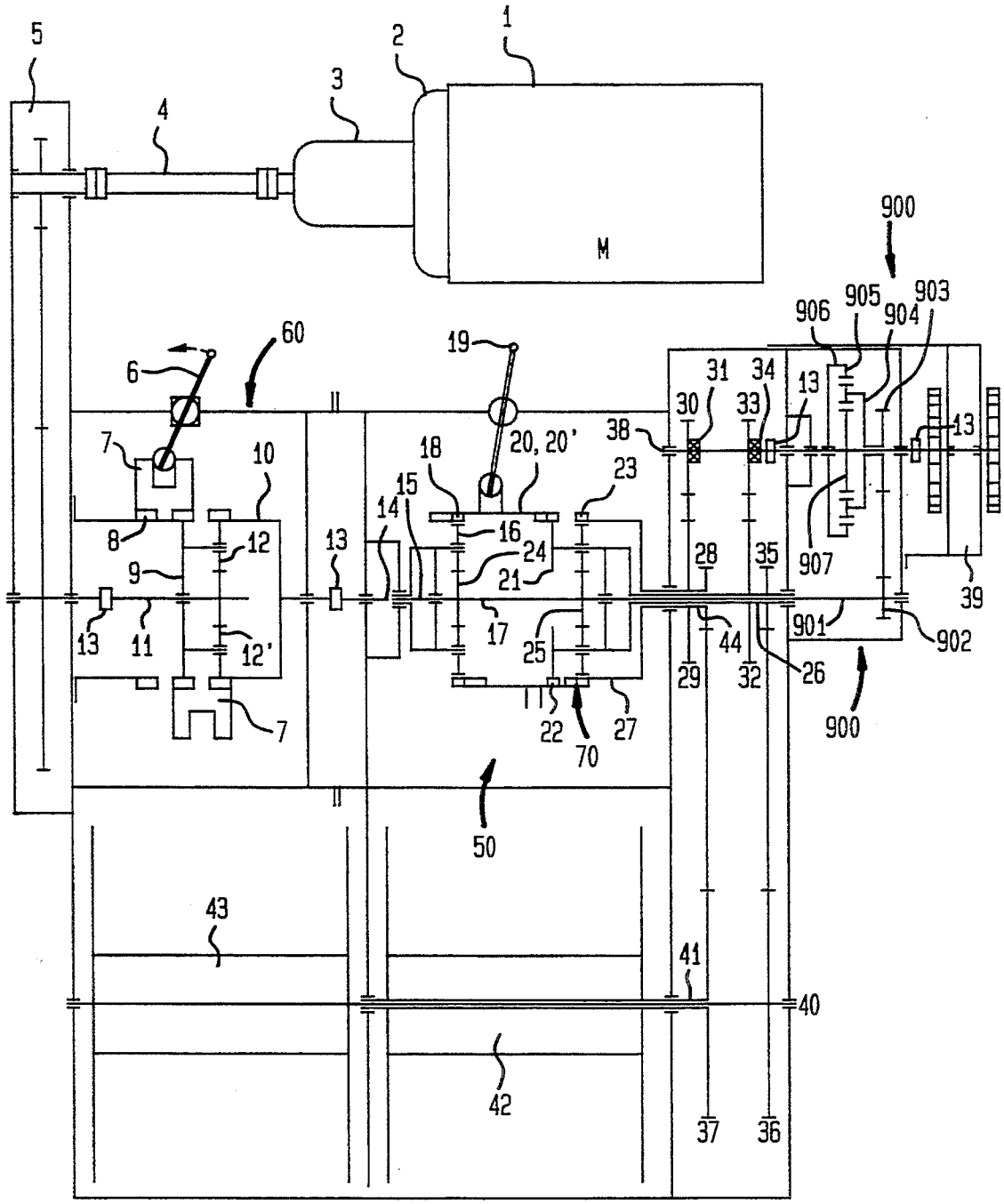
FIG. 6 is a detailed schematic illustration of a variation of the dual drum drive unit according to FIG. 5.

In the embodiment of the dual drum drive unit according to FIG. 6, the power distributor device 900 which is connected to the brake 39 is provided in form of a planetary gear train and linked via a coupling 13 to the brake shaft 38.

As shown in FIG. 6, the planetary gear train includes an annulus 906 which is driven by the brake shaft 38 and by which the major part of the torque is transmitted to planet wheels 905 and a minor portion of the necessary braking torque is transmitted to a sun wheel 907 which is nonrotatably secured to the brake 39. Since the annulus 906 is driven during downhill run by the drum unwinding the rope, and the brake 39 which is suitably provided in form of an eddy current brake generates a counter torque the planet carrier 904 is driven and transmits the torque via a gear 903, which is fixedly secured to the planet carrier 904, and the gear 902 to an extension 901 of the output shaft 17 of the motor-near gearing 50. In this manner, the torque by which the rope is drawn from the unwinding drum is almost completely transmitted to the take-up drum, to attain a very high efficiency of the dual drum drive unit.

Figure 7:
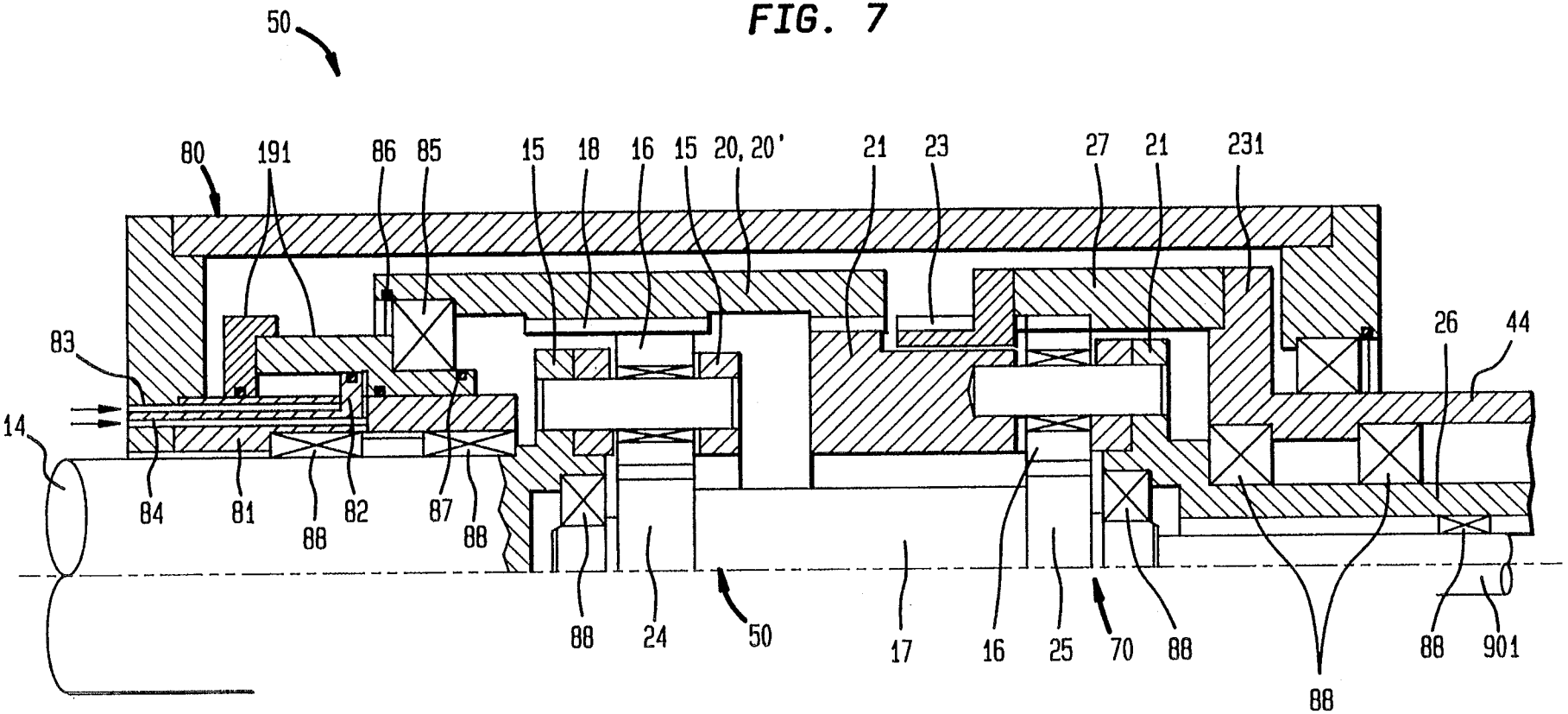
FIG. 7 is a longitudinal section of a further embodiment of a transmission unit for dividing the motor power to the drums of a dual drum drive unit according to the invention.

FIG. 7 shows a sectional view of the arrangement of both planetary gear trains 50, 70 in a practical configuration, essentially in correspondence to the embodiment as shown in FIG. 3. The annulus 20 of the gearing 50 is displaced in axial direction by pressure fluid acting upon the cylinder 191 via the flanged extension 82 of support 81. The only difference of the transmission unit according to FIG. 7 compared to the embodiment of FIG. 3 resides in the provision of the power distributor device 900 as described in connection with FIG. 6. Thus, the shaft 17 is provided with the extension 901 which is supported in the hollow output shaft 26 via a further bearing 88. Supported upon the output shaft 26 is the other output shaft 44 via further bearings 88. The connection of the power distributor device 900 with the brake shaft 38 is shown and described with regard to FIG. 6 so that a further description thereof is omitted for sake of simplicity.

Figure 8:
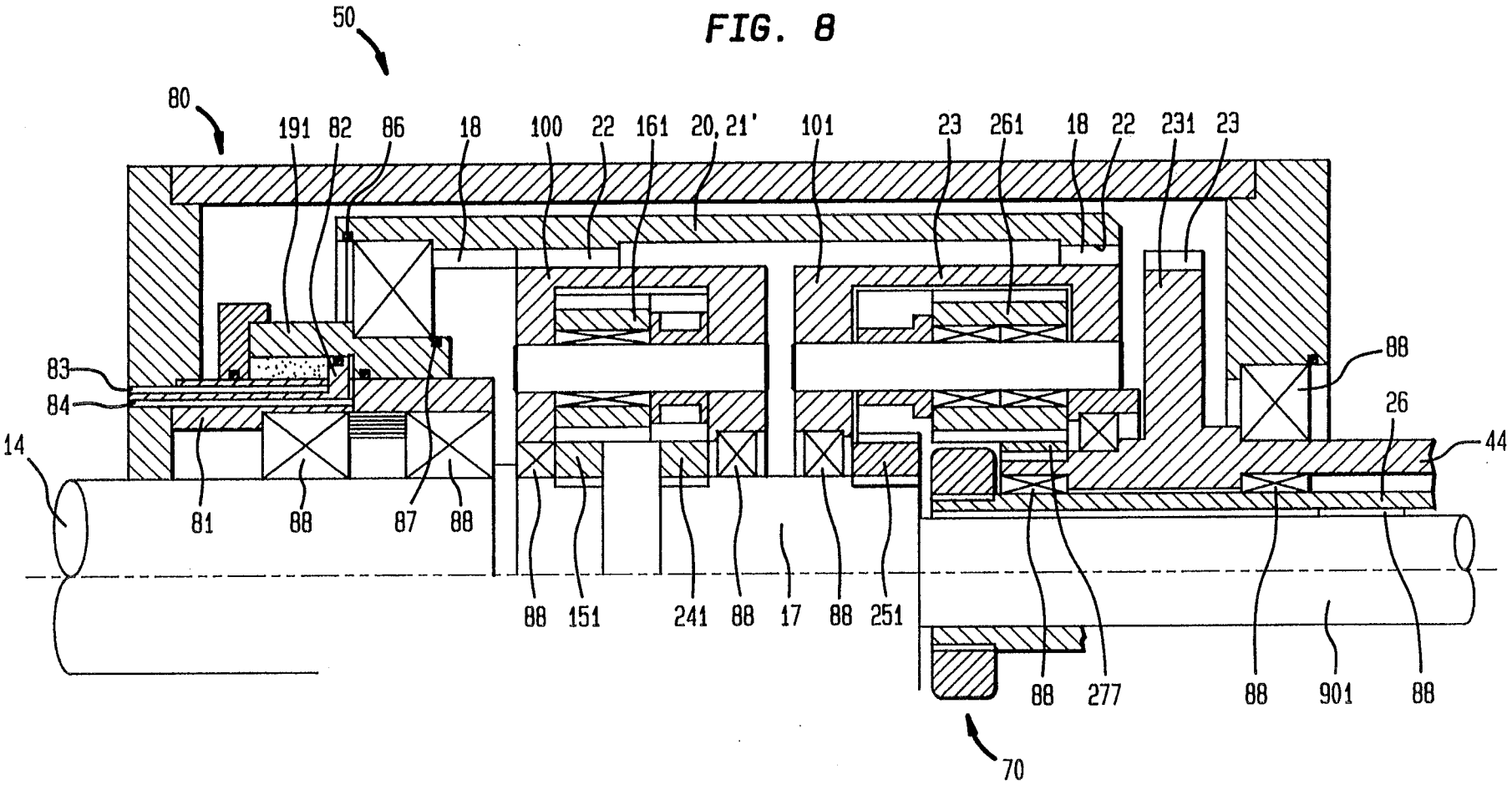
FIG. 8 is a longitudinal section of yet another embodiment of a transmission unit for dividing the motor power to the drums of a dual drum drive unit according to the invention.

Turning now to FIG. 8, there is shown a further embodiment of a transmission unit for dividing the motor power to the drums 42, 43, with the gearings 50, 70 provided in form of cylindrical gear differentials. The gearing 50 is provided with a cylindrical gear 151 which is nonrotatably secured with the shaft 14 and meshes with the differential gears 161 which are retained in a bell-shaped box 100 and mesh with an output gear 241. This output gear 241 of the gearing 50 is nonrotatably secured with a bevel gear 251 of the second gearing 70 via shaft 17 by which the boxes 100, 101 of both differentials are supported by bearings 88.

The differential gears 261 of the gearing 70 are retained in the box 101 which is nonrotatably connected to the hollow output shaft 26. The differential gears 261 are in mesh with the cylindrical gear 251 on the one hand, and with the output gear ring 271 of the hollow output shaft 44, on the other hand. The output shaft 44 is provided with a radial prolongation 231 which includes at its radial end an external toothing 23. The annulus 20 which serves as two-way switch 20′ is provided in form of a sleeve with inner toothing 18 which is engageable with the outer toothing 22 of the boxes 100, 101 or with the toothing 23 of the prolongation 231 of the output shaft 44. Displacement of the annulus in axial direction is again attained by means of the pressure fluid operated cylinder 191.

Thus, part of the torque generated by the motor 1 and supplied to the shaft 14 is transmitted by the annulus 20 either to the box 101 and thus to the hollow output shaft 26 which is non-rotatably secured thereto, or to the toothing 23 and thus to the hollow output shaft 44. The further part of the supplied torque is transmitted via the differential gears 161 of the gearing 50 to its output gear 241 and via the cylindrical gear 251 and the differential gears 261 of the gearing 70 to the output shaft 44.

As is further shown in FIG. 8, the shaft 17 is further provided with the elongation 901 which is fixedly secured to the gear 902 (FIG. 6) or to the motor 801 (FIG. 5), with the extension 901 being supported by the hollow output shaft 26.

While the invention has been illustrated and described as embodied in a dual drum drive unit, it is not intended to be limited to the details shown since various modifications and structural changes may be made without departing in any way from the spirit of the present invention.

What is claimed as new and desired to be protected by Letters Patent is set forth in the appended claims:

1. A dual drum drive unit, comprising:

a motor; and transmission means for dividing the motor power to the drums, said transmission means including a first gearing operatively connected to said motor and having a first and a second output, and a second gearing operatively connected to said first gearing and having at least a first output connected to one of the drums and a second output connected to the other one of the drums, one of the outputs of said first gearing being selectively connected to said first and second outputs of said second gearing.

2. The dual drum drive unit defined in claim 1, and further comprising an incrementally controllable reduction gear operatively connected to each of said first and second outputs of said second gearing and the pertaining drum for allowing both drums to be driven at different torques.

3. The dual drum drive unit as defined in claim 1 wherein said first and second gearings are each provided in form of a planetary gear train, with said first gearing including an annulus and said second gearing including a planet carrier which is operatively connected with one of said drums and an annulus which is operatively connected with the other one of the drums, said annulus of said first gearing being selectively connected to either said planet carrier or said annulus of said second gearing.

4. The dual drum drive unit as defined in claim 3 wherein said first gearing is further provided with planet wheels, said annulus of said first gearing being displaceable in an axial direction and provided with an internal toothing meshing with said planet wheels, said planet carrier of said second gearing being provided with a toothing and said annulus of said second gearing being provided with an external toothing wherein said internal toothing of said annulus of said first gearing is selectively engageable with the external toothing of said planet carrier and the external toothing of said annulus of said second gearing, with the internal toothing of said annulus of said first gearing having a length corresponding to the axial displacement of said annulus of said first gearing.

5. The dual drum drive unit as defined in claim 1 wherein said first and second gearings are provided in form of a differential, with said first gearing having a box and said second gearing including a box which is nonrotatably secured to one of said outputs of said second gearing and operatively connected to one of the drums and an output gear which is operatively connected with the other one of said drums, said box of said first gearing being selectively connected with either said box of said second gearing or with said output gear of said second gearing.

6. The dual drum drive unit defined in claim 5 wherein the first and second gearings are connected by a sleeve which is displaceable in an axial direction and including a toothing in engagement with the box of said first gearing and selectively engageable with said box and said output gear of said second gearing.

7. The dual drum drive unit defined in claim 1, and further comprising a brake, each of said outputs of said second gearing being operatively connected to said brake via a freewheel for allowing a braking of one or both drams unwinding a rope.

8. The dual drum drive unit defined in claim 7 wherein said brake is a non-contacting brake.

9. The dual drum drive unit defined in claim 8 wherein said non-contacting brake is an eddy current brake.

10. The dual drum drive unit defined in claim 7 wherein said brake is a hydraulic brake.

11. The dual drum drive unit defined in claim 1, and further comprising a brake and a power distributor unit, each of said outputs of said second gearing being operatively connected with said brake via a freewheel and with said first gearing via said power distributor unit so that energy applied for braking one of said drums is utilized as energy for driving the other one of said drums.

12. The dual drum drive unit as defined in claim 11 wherein said power distributor unit includes a controllable pressure fluid pump and a motor which is operated by pressure fluid and connected to said pump.

13. The dual drum drive unit defined in claim 11 wherein said power distributor unit is a torque converter.

14. The dual drum drive unit defined in claim 11 wherein said power distributor unit is connected to said brake and provided in form of a planetary gear train.

15. The dual drum drive unit defined in claim 5 wherein said first and second gearings are provided in form of cylindrical gear differentials.

* * * * *